US010065213B2

(12) United States Patent
McLean

(10) Patent No.: US 10,065,213 B2
(45) Date of Patent: Sep. 4, 2018

(54) VIBRATORY SEPARATOR SCREEN ADAPTER

(71) Applicant: M-I DRILLING FLUIDS U.K. LIMITED, Edinburgh (GB)

(72) Inventor: Claire Rosaleen Galloway McLean, Edinburgh (GB)

(73) Assignee: M-I DRILLING FLUIDS UK LTD, Aberdeen (GB)

( * ) Notice: Subject to any disclaimer, the term of this patent is extended or adjusted under 35 U.S.C. 154(b) by 0 days.

(21) Appl. No.: 14/719,069

(22) Filed: May 21, 2015

(65) Prior Publication Data

US 2016/0339477 A1 Nov. 24, 2016

(51) Int. Cl.
*B07B 1/49* (2006.01)
*B07B 1/46* (2006.01)

(52) U.S. Cl.
CPC ..... *B07B 1/4609* (2013.01); *B07B 1/46* (2013.01); *B07B 2201/02* (2013.01)

(58) Field of Classification Search
CPC ..... B07B 1/46; B07B 1/4069; B07B 2201/02
USPC ..... 209/408, 412
See application file for complete search history.

(56) References Cited

U.S. PATENT DOCUMENTS 5,769,241 A * 6/1998 Woodgate ..... B07B 1/4645 209/399
6,269,953 B1 8/2001 Seyffert et al.
6,675,975 B1 * 1/2004 Cook ..... B01D 29/012 210/490
8,517,179 B2 * 8/2013 Robertson ..... B07B 1/46 209/363
2004/0149632 A1 * 8/2004 Schulte, Jr. ..... B01D 33/0376 209/405
2005/0189265 A1 * 9/2005 Malmberg ..... B07B 1/46 209/363
2006/0219608 A1 * 10/2006 Scott ..... B01D 33/0376 209/406
2014/0183143 A1 7/2014 Cady et al.

FOREIGN PATENT DOCUMENTS

EP 2505271 A1 10/2012
WO 2016/077448 A1 5/2016

OTHER PUBLICATIONS

Combined Search Report for the equivalent UK patent application 1609001.1 dated Nov. 24, 2016.

* cited by examiner

*Primary Examiner* — Terrell H Matthews
(74) *Attorney, Agent, or Firm* — Paula B. Whitten

(57) ABSTRACT

A system includes a first screen having a first latch on a first end of the first screen, a second screen having a first catch on a first end of the second screen, and a screen adapter that connects the first screen and the second screen. The screen adapter includes an elongate body, a first catch formed on a first side of the elongate body that engages the first latch on the first end of the first screen, and a first latch formed on a second side of the elongate body that engages the first catch on the first end of the second screen. A method includes inserting a first screen into a vibratory separator, inserting a screen adapter into the vibratory separator, coupling the screen adapter to the first screen, inserting a second screen into the vibratory separator, and coupling the second screen to the screen adapter.

10 Claims, 7 Drawing Sheets

VIBRATORY SEPARATOR SCREEN ADAPTER

BACKGROUND

Vibratory separators are used to separate solid particulates of different sizes and/or to separate solid particulate from fluids. Various industries use vibratory separators for filtering materials, for example, the oil and gas industry, the food processing industry, the pharmaceutical industry, and the agriculture industry. A vibratory separator is a vibrating sieve-like table upon which solids-laden fluid is deposited and through which clean fluid emerges. The vibratory separator may be a table with a generally perforated filter screen bottom. Fluid is deposited at the feed end of the vibratory separator. As the fluid travels down the length of the vibrating table, the fluid falls through the perforations to a reservoir below, leaving the solid particulate material behind. The vibrating action of the vibratory separator table conveys solid particles left behind to a discharge end of the separator table.

A vibratory separator, as described above, will generally have several perforated filter screens, across which solids travel and through which separated particles and/or fluids pass. During normal use, screens and/or filtering elements on the screens may need to be replaced and/or repaired. Typically, the replacement and repair of screens require removing each screen individually, which can be both labor intensive and inefficient.

DETAILED DESCRIPTION

In one aspect, embodiments disclosed herein generally relate to a screen assembly. In other aspects, embodiments disclosed herein relate to a screen adapter for connecting two types of screens. In still other aspects, embodiments disclosed herein relate to methods of installing a screen assembly that includes a screen adapter.

Figure 1:
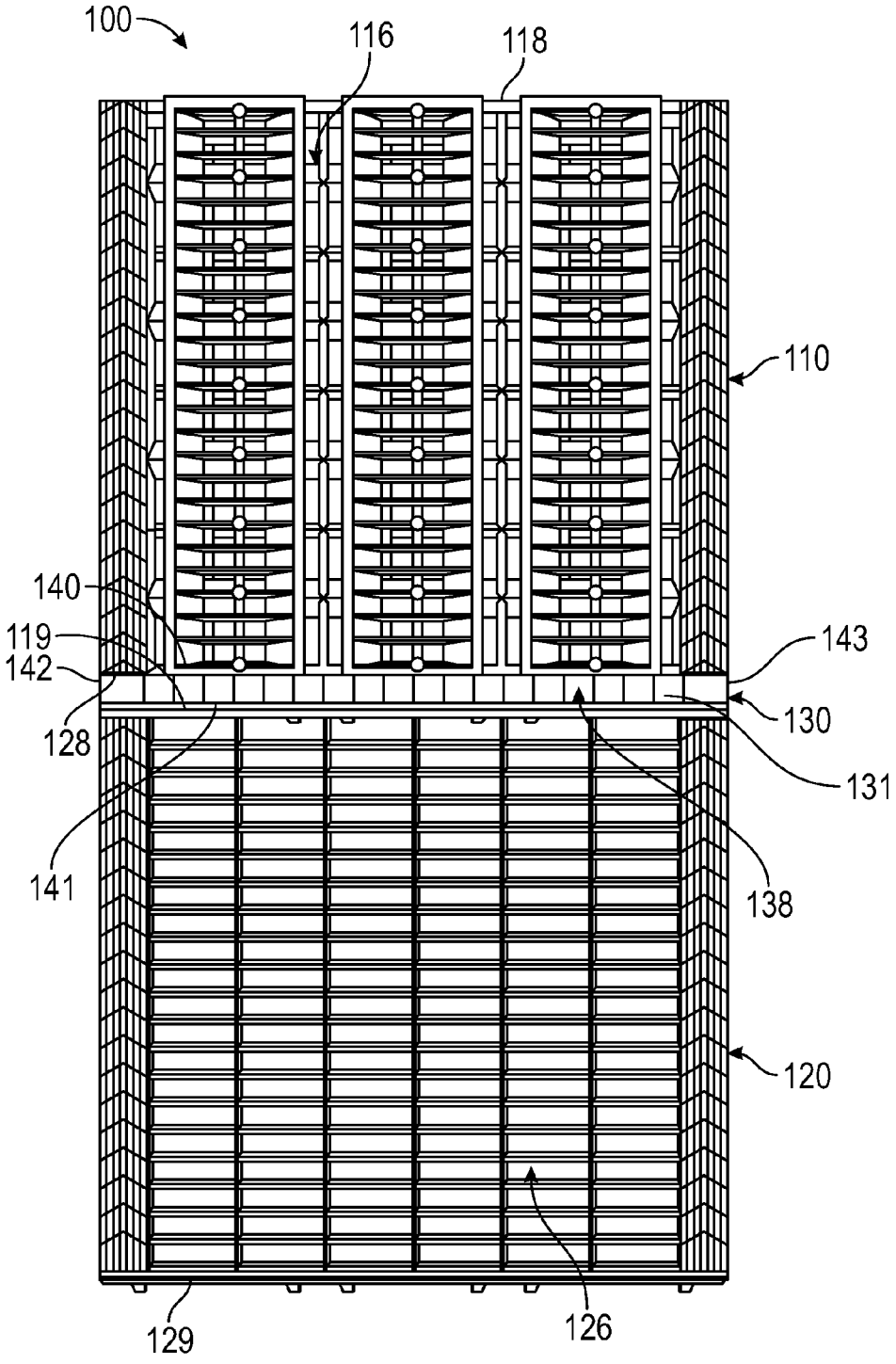
FIG. 1 is a top view of a screen assembly according to one or more embodiments of the present disclosure.

Referring to FIG. 1, a top view of a screen assembly 100 according to one or more embodiments of the present disclosure is shown. In one or more embodiments, a first screen 110 and a second screen 120 may be connected to each other via a screen adapter 130. The first screen 110 may include a top surface 116, a bottom surface (not shown), a first end 118, and a second end 119. Further, the second screen 120 may include a top surface 126, a bottom surface (not shown), a first end 128, and a second end 129. In one or more embodiments of the present disclosure, the top surface 116 of the first screen 110 and the top surface 126 of the second screen 120 include perforations or openings such that the top surfaces 116, 126 may receive a fluid and filter out solids from the fluid. Although reference is made herein to filtering a solid from a fluid, one of ordinary skill in the art will appreciate that apparatus and methods described herein may also be used for solids of different sizes, for example, filtering sized particulate matter. The screen adapter 130 may include an elongate body 131 that has a top surface 138 that is solid (i.e., does not include any perforations or openings) to prevent solids from the fluid from bypassing the first screen 110 and the second screen 120, as well as a bottom surface (not shown). However, in one or more embodiments, the top surface 138 of the screen adapter 130 may include perforations, openings, and/or a filtering material (not shown) that may, for example, receive fluid and filter out solids from the fluid. Further, in one or more embodiments, a filter material on the top surface 138 of the screen adapter 130 may be a mesh filter or any other filter known in the art sized to remove solids or particulate matter of a given size. A length of the screen adapter 130, i.e., the length extending from a first end 142 of the screen adapter 130 to a second end 143 of the screen adapter 130, may be approximately equal to a width of the first screen 110 and/or the second screen 120. For example, if a screen has dimensions of 23 inches by 49.5 inches, the length of the screen adapter 130 may be approximately 23 inches. In another example, a screen may have dimensions of 25 inches by 49 inches and the length of the screen adapter 130 may be approximately 25 inches. A width of the screen adapter 130, i.e., the distance from a first side 140 of the screen adapter 130 to a second side 141 of the screen adapter 130, may be less than a length or width of the first and/or second screens 110, 120. For example, the width of the screen adapter 130 may be an inch, two inches, three inches, or more. One of ordinary skill in the art will appreciate that a screen adapter 130 in accordance with embodiments disclosed herein may be formed with varying sizes and configurations based on, for example, the size and configuration of one or more screens, a screen bed, and/or a vibratory separator, and is not limited to the examples provided herein.

Figure 2:
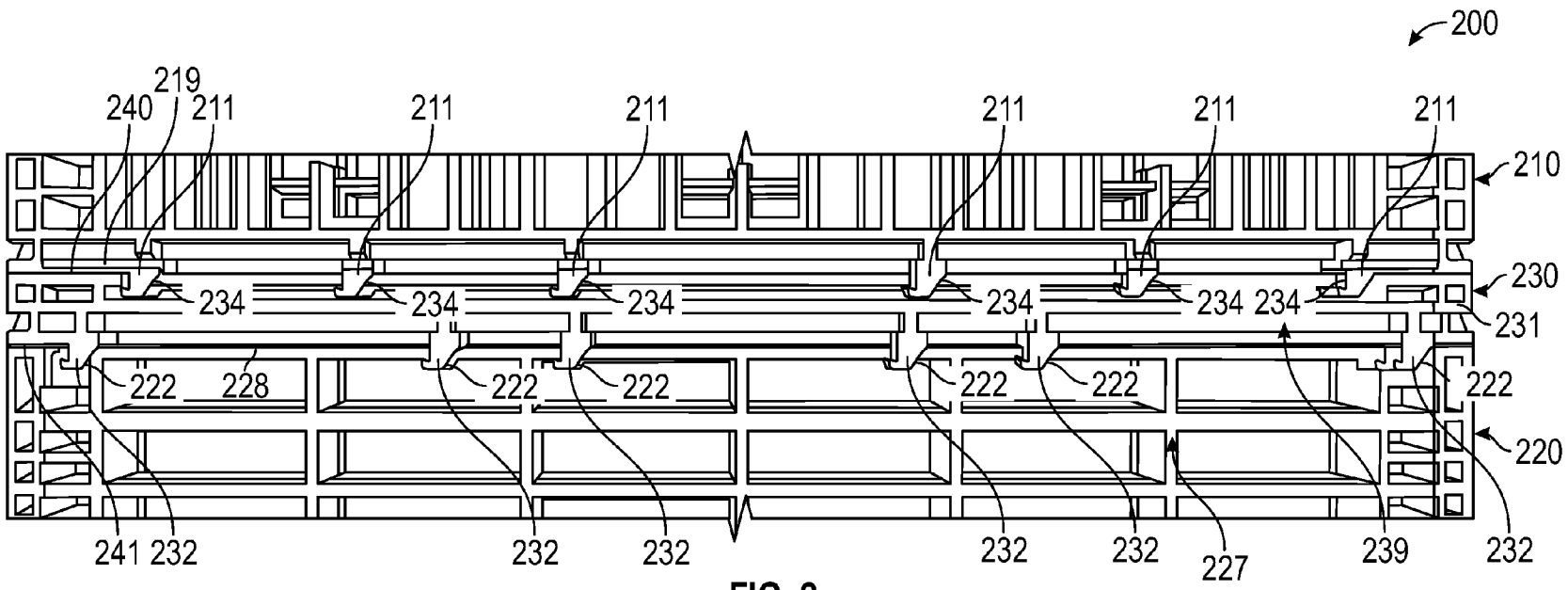
FIGS. 2 and 3 are bottom views of a screen assembly according to one or more embodiments of the present disclosure.
Figure 3:
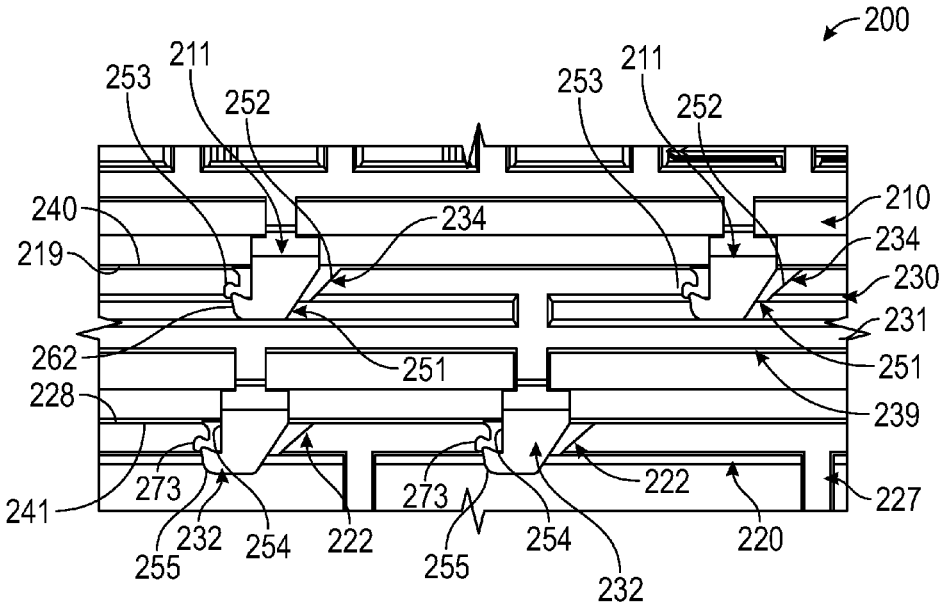

Referring to FIGS. 2 and 3, bottom views of a screen assembly 200 according to one or more embodiments of the present disclosure is shown. In one or more embodiments, a first screen 210 and a second screen 220 may be connected to each other via a screen adapter 230. The first screen 210 may have catches (not shown) on a first end (not shown) of the first screen 210 and latches 211 on a second end 219 of the first screen 210. Similarly, the second screen 220 may have catches 222 on a first end 228 of the second screen 220 and latches (not shown) on a second end (not shown) of the second screen 220. In some embodiments, each screen 210, 220 may include catches and/or latches on only one end. While a plurality of latches and catches are shown in this embodiment, in one or more embodiments, the first screen and the second screen may have a single latch or a single catch on one or each end of each screen.

Additionally, in one or more embodiments, the screen adapter 230 may have an elongate body 231, catches 234, and latches 232. The catches 234 of the screen adapter 230 may be disposed on a first side 240 of the elongate body 231 such that the catches 234 may receive the latches 211 of the first screen 210. The latches 232 of the screen adapter 230 may be disposed on a second side 241 of the elongate body 231 such that the latches 232 may engage the catches 222 of the second screen 220. While a plurality of latches and catches are shown in this embodiment, in one or more embodiments, the screen adapter may have a single catch on a first side and a single latch on a second side, and the catch and latch of the screen adapter may match or correspond to the latch and catch on the first and second screens, respectively. The catch(es) and latch(es) of the screen adapter may match or correspond to the latch(es) and catch(es) of the first and second screens such that mating latch(es) and catch(es) are located or aligned at corresponding locations and include complementary or engaging profiles.

In one or more embodiments of the present disclosure, the first screen 210 and the second screen 220 may be different types of screens. Each of the first screen 210 and the second screen 220 may be one of a high capacity screen, a regular capacity screen, and other types of known screens for vibratory separators. The latches and the catches of each different type of screen may be arranged in a different profile along ends of the screens. In addition, in one or more embodiments, the latches and catches of each different type of screen may have a different structure. As such, in one or more embodiments of the present disclosure, the latches 232 of the screen adapter 230 may be arranged in a profile along the second side 241 of the elongate body 231 that matches the profile of the catches 222 of the second screen 220. Further, the catches 234 of the screen adapter 230 may be arranged in another profile along the first side 240 of the elongate body 231, which is different from the profile of the latches 232, that matches the profile of the latches 211 of the first screen 210. In other words, the profile of the latches 211 of the first screen 210 may be different from the profile of the catches 222 of the second screen, and therefore, the profile of the latches 232 of the screen adapter 230 may be different from the profile of the catches 234 of the screen adapter 230.

Additionally, referring to FIGS. 2 and 3, in one or more embodiments, the latches 211 of the first screen 210 may be structurally identical to the latches 232 of the screen adapter 230. In one or more embodiments, the latches 232 formed on the second side 241 of the elongate body 231 may be vertical latches. A latch 232 that is a vertical latch may include an extension portion 254 and an engagement portion 255. The extension portion 254 may protrude from the elongate body 231 in a direction that is orthogonal to the second side 241 of the screen adapter 230, and the extension portion 254 may extend a selected distance between the top surface and the bottom surface 239 of the screen adapter 230. Further, in one or more embodiments, the engagement portion 255 may extend from the extension portion 254 in a direction that intersects a plane defined by the second side 241 of the elongate body 231. In addition, the engagement portion 255 may extend from the extension portion 254 such that it may engage an engagement portion 273 of a catch 222 of the second screen 220 and create a connection between the screen adapter 230 and the second screen 220. In other embodiments, the engagement portion 255 may extend in a direction that is orthogonal to the extension portion 254. Further, in other embodiments, the extension portion 254 may protrude from the elongate body 231 in a direction generally orthogonal to the second side 241, but may include an angle between the extension portion 254 and the second side 241. Similarly, the engagement portion 255 may extend generally orthogonal to the extension portion 254, but may include an acute angle between an inner surface of the engagement portion 255 and an inner surface of the extension portion 254 to facilitate engagement and securement of the screen adapter 230 to the first and/or second screen 210, 220.

Further, in one or more embodiments, the catches 222 of the second screen 220 may be structurally identical to the catches 234 of the screen adapter 230. In one or more embodiments, each catch 234 of the screen adapter 230 may include a recess 251, a guide portion 252, and an engagement portion 253, and each catch 234 may be structured such that it receives a vertical latch. The recess 251 may be an opening in the first side 240 of the elongate body 231 through which the latch 211 of the first screen 210 may pass. The recess 251 may extend through the top surface (not shown) and/or bottom surface 227, 239 of the second screen 220 and/or screen adapter 230. Further, the guide portion 252 may be angled or curved from the first side 240 towards the recess 251 such that the screen latch is directed into the recess 251. Furthermore, the engagement portion 253 may extend partially into the recess 251 on the first side 240 such that it may engage an engagement portion 262 of the latch 211 of the first screen 210 and create a connection between the screen adapter 230 and the first screen 210. While the structures of the latches and catches described above are identical, it is not necessary that the structure of the latches and the catches be identical, and the latches and catches of each screen and the screen adapter may be structurally different.

Further, referring to FIGS. 2 and 3, in one or more embodiments, the screen assembly 200 may be assembled within a vibratory separator (not shown). In one or more embodiments, during assembly of the screen assembly 200, the first screen 210 may be inserted into the vibratory separator such that the latches 211 on the second end 219 of the first screen 210 remain exposed. In one or more embodiments, the screen adapter 230 may be inserted into the vibratory separator such that the catches 234 on first side 240 of the screen adapter 230 face the latches 211 on the second end 219 of the first screen 210. The catches 234 on the first side 240 of the screen adapter may be lined up with and coupled to the latches 211 on the second end 219 of the first screen 210. Further, the second screen 220 may be inserted into the vibratory separator such that the catches 222 on the first end 228 of the second screen 220 face the latches 232 on the second side 241 of the screen adapter 230. The catches 222 on the first end 228 of the second screen 220 may be lined up with and coupled to the latches 232 on the second side 241 of the screen adapter 230. Further, since the first screen 210 and the second screen 220 may be each coupled to the screen adapter 230 within the vibrator separator, the first screen 210, the second screen 220, and the screen adapter 230 may be removed from the vibratory separator together. In other words, each member in the screen assembly 200 may be coupled to each other such that the screen assembly 200 is removed from the vibratory separator all at once. In some embodiments, the screens 210, 210 and screen adapter 230 may be moved horizontally toward one another such that the latches insert into the recess of the catch and the latches flex or elastically bend such that the engagement portion of the latch moves into locking engagement with the engagement portion of the catch. In other embodiments, the screens 210, 220, and screen adapter 230 may be coupled by vertically engaging each component together. For example, the screen adapter 230 may be held above the first screen 210 such that the catch(es) and latch(es) vertically align. The screen adapter may then be lowered such that the latch(es) and catch(es) of the first screen 210 and screen adapter 230 slidingly engage.

Figure 4:
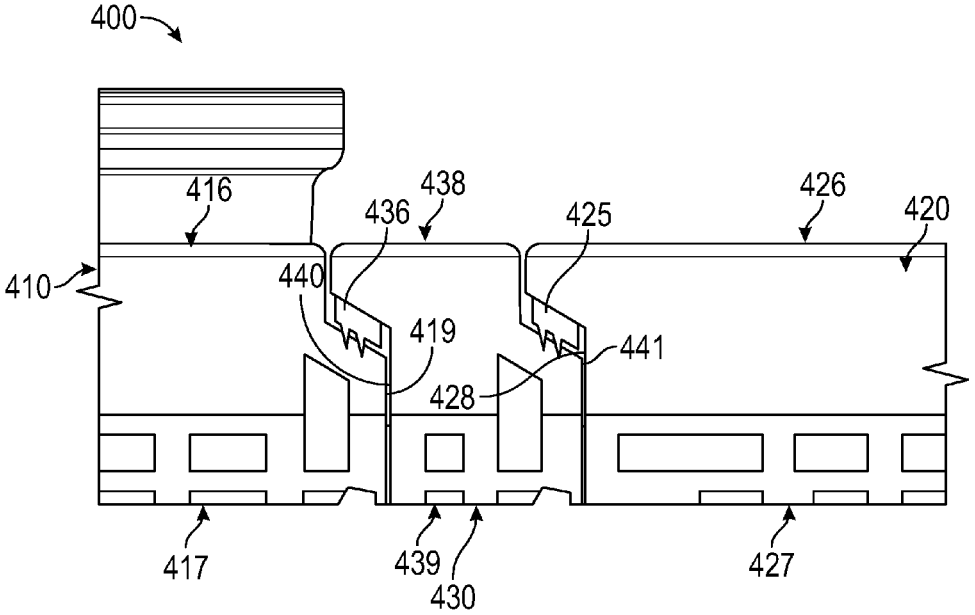
FIG. 4 is a side view of a screen assembly according to one or more embodiments of the present disclosure.

Referring to FIG. 4, a side view of a screen assembly 400 according to one or more embodiments of the present disclosure is shown. As discussed above, in one or more embodiments, the screen assembly 400 may include a first screen 410, a second screen 420, and a screen adapter 430. The first screen 410 and the second screen 420 may be coupled together via the screen adapter 430. In other words, the first screen 410 may have a latch (not shown) on a second end 419 of the first screen 410 that is adjacent to a first side 440 of the screen adapter 430 that has a corresponding catch (not shown). Further, the second screen 420 may have a catch (not shown) on a first end 428 of the second screen 420 that is adjacent to a second side 441 of the screen adapter 430 that has a corresponding latch (not shown). As shown in FIG. 4, the latches and catches are engaged such that the screens are coupled to one another via the screen adapter 430 without a gap or large space separating the screens 410, 420 and the adapter 430. Additionally, a top surface 416 of the first screen 410, a top surface 426 of the second screen 420, and a top surface 438 of the screen adapter 430 may be offset from a bottom surface 417 of the first screen 410, a bottom surface 427 of the second screen 420, and a bottom surface 439 of the screen adapter 430, respectively.

Further, one or more of the first screen 410, the second screen 420, and the screen adapter 430 may include a seal disposed on a surface proximate a surface of another component, e.g., the screen adapter 430 or a screen. For example, a seal (not shown) may be disposed on a surface of the first screen 410 proximate the top surface 416, a seal 425 may be disposed on a surface of the second screen 420 proximate the top surface 426, and/or a seal 436 may be disposed on a surface of the screen adapter 430 proximate the top surface 438. Each seal may form a seal against a top surface of another screen or screen adapter in order to prevent solid particles from bypassing the first screen 410 and the second screen 420. For example, as shown, the seal 425 of the second screen 420 may be configured to contact a surface of the screen adapter 430 and the seal 436 may be configured to contact a surface of the first screen 410. The seals may be disposed on a surface of the screen and/or screen adapter that is angled and extends from the offset top surface (e.g., 426, 438) to the end or side of the screen and/or screen adapter (420, 430). One of ordinary skill in the art will appreciate that the seals may extend along a length of the end of the screens 410, 420 and/or a length of the side of the screen adapter 430. The seal may extend the total length of the end or side of the screen and screen adapter, respectively, or portions of the length. The seal may be integrally formed with the screen and/or screen adapter, co-molded, or otherwise coupled to the screen and/or screen adapter, for example by mechanical fastener, adhesives, bonding, etc. Further, one of ordinary skill in the art will appreciate that the seal may be formed from any material known in the art, for example, elastomers, polymers, nylons, and composites.

Figure 5:
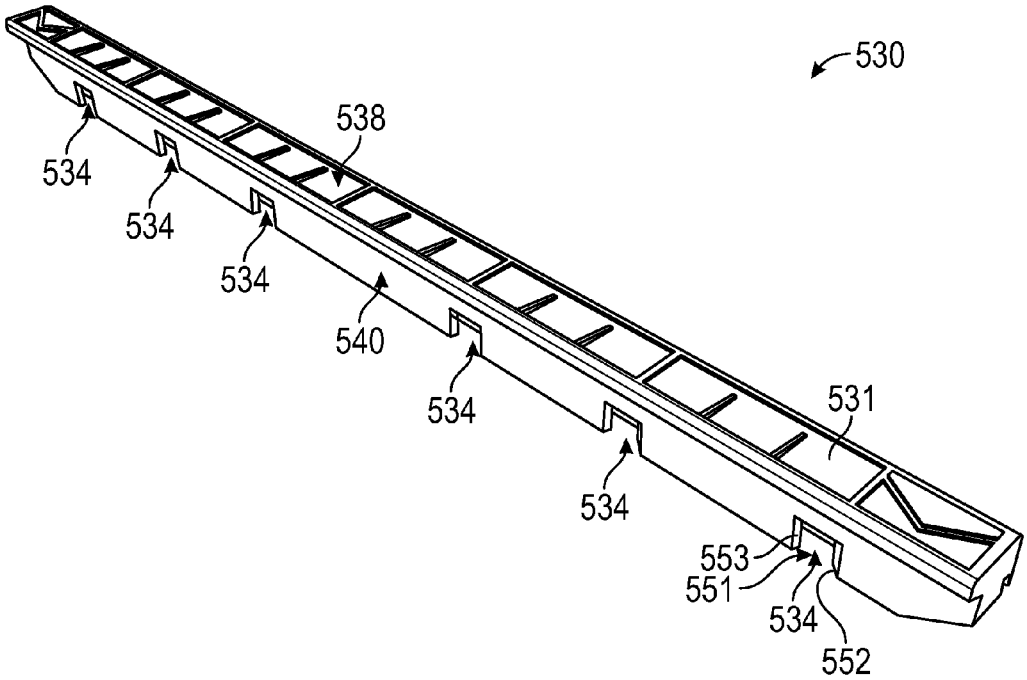
FIG. 5 is a perspective view of a screen adapter according to one or more embodiments of the present disclosure.
Figure 6:
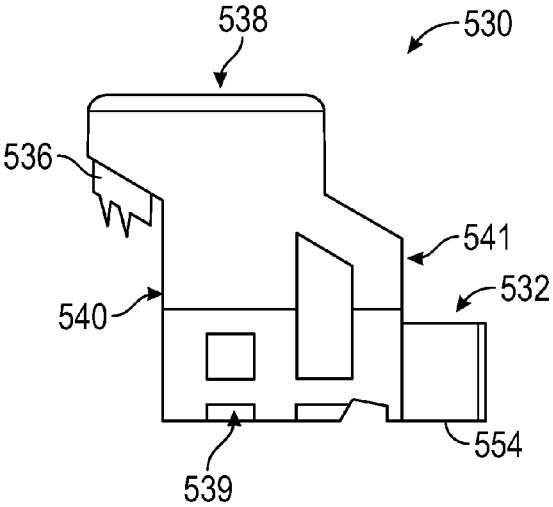
FIG. 6 is a side view of a screen adapter according to one or more embodiments of the present disclosure.

Referring to FIGS. 5 and 6, a perspective view and a side view of a screen adapter 530 according to one or more embodiments of the present disclosure is shown. In one or more embodiments, a screen adapter 530 may include an elongate body 531, catches 534, and latches 532. The elongate body has a top surface 538, a bottom surface 539, a first side 540, and a second side 541. Further, the top surface 538 of the elongate body 531 may be offset from the bottom surface 539 of the elongate body 531. In one or more embodiments, the screen adapter 530 may include a seal 536 proximate the top surface 538 and adjacent to the first side 540 such that the seal may rest against or contact a surface proximate an offset top surface of an adjacent screen. Additionally, in one or more embodiments, the seal 536 may be adjacent to the second side 541 of the screen adapter 538 proximate the top surface 538 that is offset from the bottom surface 531 of the screen adapter 530.

Referring to FIGS. 5 and 6, in one or more embodiments, the catches 534 may be formed on the first side 540 of the elongate body 531, adjacent to the bottom surface 539. As discussed above, in one or more embodiments, each catch 534 may include a recess 551, a guide portion 552, and an engagement portion 553. The recess 551 may be an opening in the first side 540 of the elongate body 531 through which a screen latch (not shown) may pass. The recess may extend through the bottom surface 531. Further, the guide portion 552 may be angled from the first side 540 towards the recess 551 such that the screen latch is directed into the recess 551. Furthermore, the engagement portion 553 may extend partially into the recess 551 on the first side 540 such that it may engage an engagement portion of the screen latch (not shown) and create a connection between the screen adapter 530 and a screen (not shown). In one or more embodiments, the recess 551, the guide portion 552, and the engagement portion 553 of the catch 534 may be oriented such that the catch 534 receives a screen latch that is a vertical latch.

Further, in one or more embodiments, the latches 532 may be formed on the second side 541 of the elongate body 531, adjacent to the bottom surface 539, and the latches 532 may be oriented such that the latches 532 are vertical latches. As discussed above, in one or more embodiments, a latch 532 that is a vertical latch may include an extension portion 554 and an engagement portion (not shown). The extension portion 554 may protrude from the elongate body 531 in a direction that is orthogonal to the second side 541. Further, in one or more embodiments, the engagement portion may extend from the extension portion 554 in a direction that intersects a plane defined by the second side of the elongate body 531. In addition, the engagement portion may extend from the extension portion 554 such that it may engage an engagement portion of a screen catch (not shown) and create a connection between the screen adapter 530 and a screen (not shown). Although FIGS. 5 and 6 show a latch 532 on the second side 541 of the screen adapter 530 and catches 534 on the first side 540, one of ordinary skill in the art will appreciate that the latch 532 may be on the first side 540 and the catch 534 on the second side 541, such that in some embodiments the top surface 538 is offset over the catches 534 (as shown in FIG. 6) and in some embodiments, the top surface 538 is offset over the latches 532.

Figure 7:
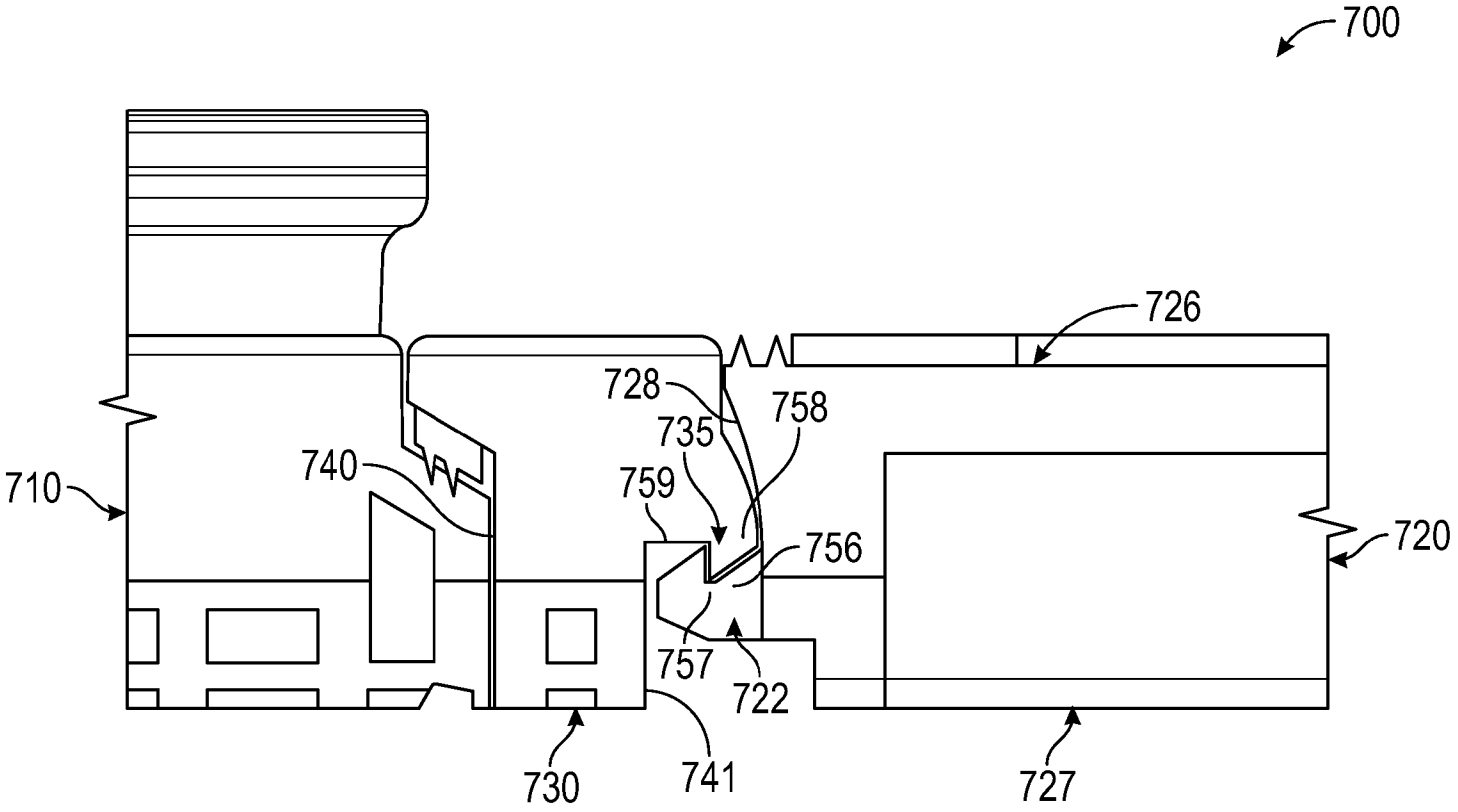
FIG. 7 is a side view of a screen assembly according to one or more embodiments of the present disclosure.

Referring to FIG. 7, a side view of a screen assembly 700 according to one or more embodiments of the present disclosure is shown. As discussed above, in one or more embodiments, the screen assembly 700 may include a first screen 710, a second screen 720, and a screen adapter 730, and the first screen 710 and the second screen 720 may be coupled together via the screen adapter 730. In one or more embodiments, the screen adapter may have a catch (not shown) on a first side 740 that is designed to receive a vertical latch (not shown) of the first screen 710 and a catch 735 on a second side 741 that is designed to receive a horizontal latch 722 of the second screen 720.

In one or more embodiments, the horizontal latch 722 may include an extension portion 756 and an engagement portion 757. Similar to vertical latches, the extension portion 756 of the horizontal latch 722 may protrude from a first end 728 of the second screen 720 in a direction that is orthogonal to the first end 728 of the second screen 720. However, the horizontal latch 722 extends along a width of the second screen 720 or length of the screen adapter 730, and the engagement portion 757 of the horizontal latch 722 extends from the extension portion 756 in a direction that is orthogonal to a plane defined by a top surface 726 (or bottom surface 727) of the second screen 720. As shown, in one or more embodiments, the engagement portion 757 extends from the extension portion 756 toward the top surface 726 of the second screen 720. In addition, the engagement portion 757 of the horizontal latch 722 may extend from the extension portion 756 such that it may engage an engagement portion 758 of the catch 735 of the screen adapter 730. Further, the engagement portion 758 of the catch 735 of the screen adapter 730 may extend from the second side 741 such that it creates a gap or groove 759 into which the horizontal latch 722 may enter. As shown, the catch 735 opens downward, such that the gap or groove 759 faces toward the bottom surface 739 of the screen adapter 730. Furthermore, the engagement portion 757 of the horizontal latch 722 may engage the engagement portion 758 of the catch 735 and create a connection between the screen adapter 730 and the second screen 720 when the horizontal latch 722 is within the gap 759 of the catch 735.

Figure 8:
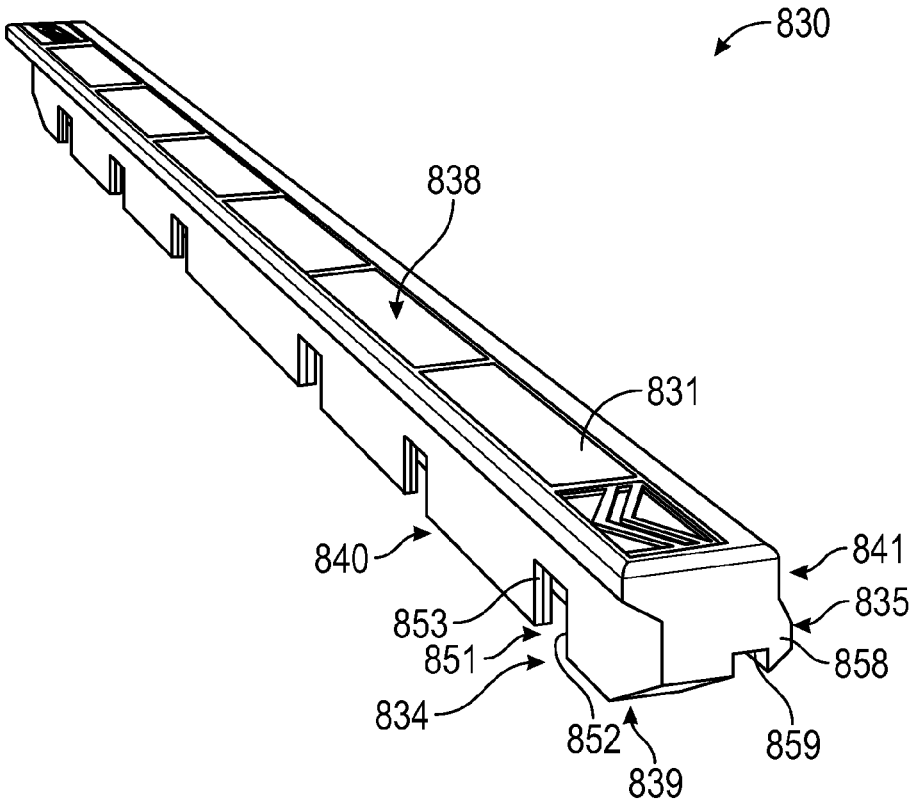
FIG. 8 is a perspective view of a screen adapter according to one or more embodiments of the present disclosure.
Figure 9:
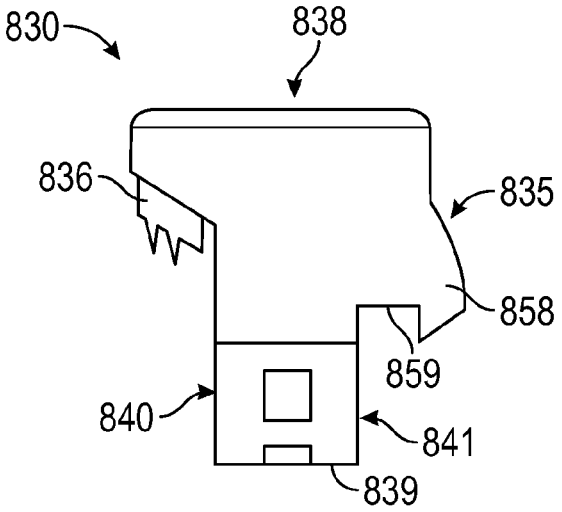
FIG. 9 is a side view of a screen adapter according to one or more embodiments of the present disclosure.

Referring to FIGS. 8 and 9, a perspective view and a side view of a screen adapter 830 according to one or more embodiments of the present disclosure is shown. In one or more embodiments, the screen adapter 830 may have an elongate body 831, catches 834 on a first side 840 of the elongate body 831, and catches 835 on a second side 841 of the elongate body 831. Further, a top surface 838 of the elongate body 831 may be offset from a bottom surface 839 of the elongate body 831. Further, a seal 836 may be disposed on a surface of the screen adapter 830 proximate the top surface 838 of the elongate body 831 and adjacent to the first side 840 of the elongate body 831 such that the seal 836 may rest against or contact a surface proximate an offset top surface of an adjacent screen. One of ordinary skill in the art will appreciate that in some embodiments, a first seal, such as seal 836, may be located on a surface proximate the first side 840 of the elongate body 831 and a second seal (not shown) may be located on a surface proximate the second side 841 of the elongate body 831. In other embodiments, a seal may be disposed proximate the second side 841 of the elongate body 831, but not on or proximate the first side 840. A seal disposed proximate the second side 841 of the elongate body 831 may be located, for example, on a surface of the catch 835 (e.g., engagement portion 858, groove 859) or on the second side 841. In yet other embodiments, elongate body 831 may not include a seal coupled thereto.

Referring to FIGS. 8 and 9, in one or more embodiments, the catches 834 on the first side 840 of the elongate body 831 may be designed to receive a vertical latch (not shown) on a first screen (not shown). In one or more embodiments, as discussed above, catches 834 that receive a vertical latch may include a recess 851, a guide portion 852, and an engagement portion 853. The recess 851 may be an opening in the first side 840 of the elongate body 831 through which a screen latch (not shown) may pass. Further, the guide portion 852 may be angled from the first side 840 towards the recess 851 such that the screen latch is directed into the recess 851. Furthermore, the engagement portion 853 may extend partially into the recess 851 on the first side 840 such that it may engage an engagement portion of the vertical latch of the first screen and create a connection between the screen adapter 830 and the first screen.

Additionally, in one or more embodiments, the catches 835 on the second side 841 of the elongate body 831 may be designed to receive a horizontal latch (not shown) on a second screen (not shown). In one or more embodiments, as discussed above, catches 835 that receive a horizontal latch may include an engagement portion 858 that extends from the second side 841 of the elongate body 831 such that it creates a gap or groove 859 into which a horizontal latch may enter. As shown, the catch 835 may open downward, such that the gap or groove 859 faces toward the bottom surface 839. Further, the engagement portion 858 may be formed such that it may engage an engagement portion of the horizontal latch of the second screen to form a connection between the screen adapter 830 and the second screen.

Figure 10:
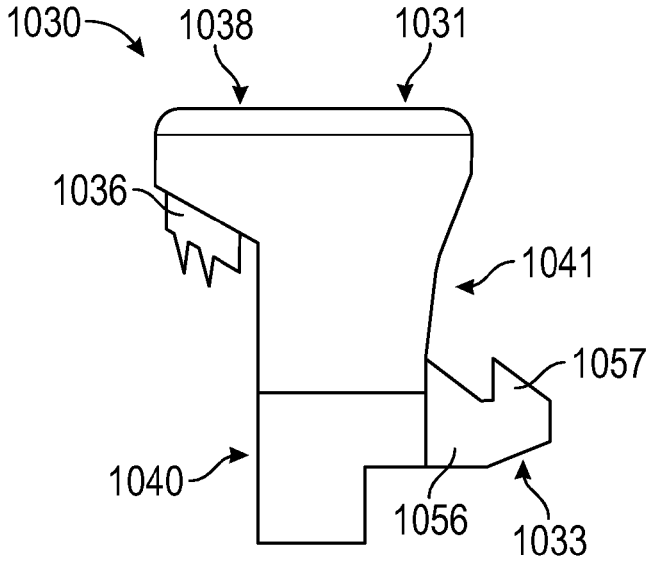
FIG. 10 is a side view of a screen adapter according to one or more embodiments of the present disclosure.

Referring to FIG. 10, a side view of a screen adapter 1030 according to one or more embodiments of the present disclosure is shown. In one or more embodiments, the screen adapter 1030 may have an elongate body 1031, a seal 1036 disposed on a surface proximate a top surface 1038 and adjacent to a first side 1040, a catch (not shown) on the first side 1040 of the elongate body 1031, and a latch 1033 on a second side 1041 of the elongate body 1031. The latch 1033 may be a horizontal latch that may include an extension portion 1056 and an engagement portion 1057. As discussed above, a horizontal latch may be similar to a vertical latch. For example, the extension portion 1056 of the latch 1033 may protrude from the second side 1041 of the screen adapter 1030 in a direction that is orthogonal to the second side 1041 of the screen adapter 1030. However, the horizontal latch 1033 extends along a length of the screen adapter, and the engagement portion 1057 of the latch 1033 may extend from the extension portion 1056 in a direction that is orthogonal to a plane defined by a top surface 1038 of the screen adapter 1030. In addition, the engagement portion 1057 of the latch 1033 may extend from the extension portion 1056 such that it may engage an engagement portion of a catch (not shown) of an adjacent screen (not shown).

Figure 11:
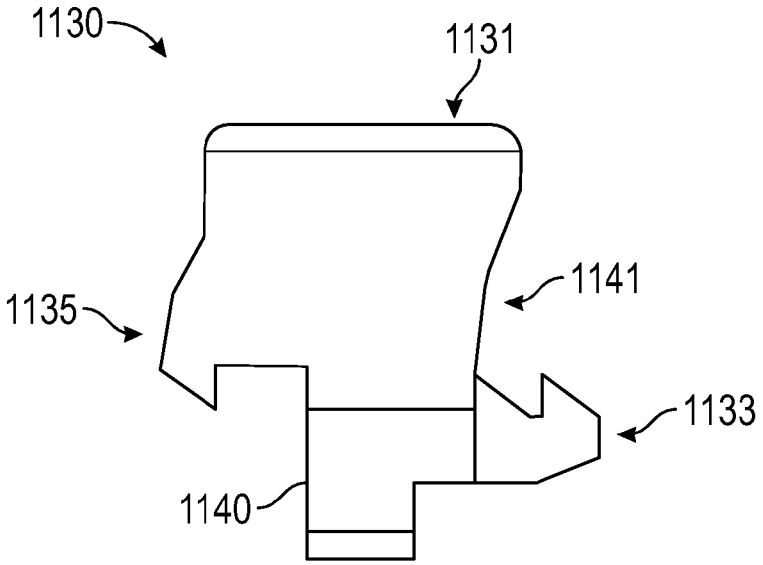
FIG. 11 is a side view of a screen adapter according to one or more embodiments of the present disclosure.

Referring to FIG. 11, a side view of a screen adapter 1130 according to one or more embodiments of the present disclosure is shown. In one or more embodiments, the screen adapter 1130 may have an elongate body 1131, a catch 1135 on a first side 1140 of the elongate body 1131, and a latch 1133 on a second side 1141 of the elongate body 1131. The catch 1135 may be a horizontal catch designed to receive a horizontal latch of an adjacent screen, and the latch 1133 may be a horizontal latch designed to engage a horizontal catch of another adjacent screen. The structures of the horizontal latch and the horizontal catch are substantially similar to the horizontal catch and horizontal latch structures described above.

In one or more embodiments, a screen assembly may include a first screen and a second screen coupled via a screen adapter. The first screen may have both latches and catches on a first end of the first screen that is adjacent to the screen adapter. Similarly, the second screen may have both latches and catches on a first end of the second screen that is adjacent to the screen adapter. In one or more embodiments, the screen adapter may have latches and catches on a first side of the screen adapter that is adjacent to the first screen, and the latches and catches on the first side of the screen adapter may be disposed such that they match up with the structure and profile of arrangement of the latches and catches of the first screen. In addition, the screen adapter may have latches and catches on a second side of the screen adapter that is adjacent to the second screen, and the latches and catches on the second side of the screen adapter may be disposed such that they match up with the structure and profile of arrangement of the latches and catches of the second screen.

Further, in one or more embodiments, the first screen may have catches on a first end of the first screen that is adjacent to the screen adapter, and the second screen may have catches on a first end of the second screen that is adjacent to the screen adapter. In one or more embodiments, the screen adapter may have latches on a first side adjacent to the catches of the first screen and latches on the second side adjacent to the catches of the second screen. Therefore, in one or more embodiments, the screen adapter may have latches on the first side that match the structure and profile of arrangement of the catches of the first screen and latches on the second side that matches the structure and profile of arrangement of the catches of the second screen.

Further, while embodiments disclosed herein describe catches and latches with respect to a first or second end of a screen, one of ordinary skill in the art will appreciate that the first and second ends equally encompass first, second, third, or fourth sides of a screen. For example, a screen assembly in accordance with embodiments disclosed herein may include a screen adapter coupled between ends of two screens or between sides of two screens or between a side and an end of a screen.

Additionally, in one or more embodiments, the first screen, the second screen, and the screen adapter of a screen assembly may contain both horizontal latches and vertical latches and the corresponding catches depending on the type of screens that are utilized.

A method in accordance with embodiments disclosed herein includes inserting a first screen into a vibratory separator, inserting a screen adapter into the vibratory separator, coupling the screen adapter to the first screen, inserting a second screen into the vibratory separator, and coupling the second screen to the screen adapter. One of ordinary skill in the art will appreciate that the order of the inserting and coupling may vary without departing from the scope of embodiments disclosed herein. For example, in some embodiments, the first screen and the second screen may be inserted into the vibratory separator before the screen adapter. The screen adapter may then be inserted into the vibratory separator and coupled to the first screen and the second screen simultaneously or separately. Further, in some embodiments, the screen adapter may be coupled to the first screen and/or the second screen before the coupled screen(s) and adapter are inserted into the vibratory separator.

In some embodiments, coupling the screen adapter to the first screen includes aligning the first latch on the first side of the first screen with the first catch on the first side of the screen adapter, and engaging the first latch on the first side of the first screen with the first catch on the first side of the screen adapter. Coupling the screen adapter to the second screen includes aligning the first latch on the second side of the screen adapter with the first catch on the first side of the second screen, and engaging the first latch on the second side of the screen adapter with the first catch on the first side of the second screen.

In some embodiments, engaging the first latch on the first side of the first screen with the first catch on the first side of the screen adapter includes guiding an engagement portion of the first latch on the first side of the first screen into a recess of the first catch on the first side of the screen adapter, and engaging the engagement portion of the first latch on the first side of the first screen with an engagement portion of the first catch on the first side of the screen adapter. Engaging the first latch on the second side of the screen adapter with the first catch on the first side of the second screen includes guiding an engagement portion of the first latch on the second side of the screen adapter into a recess of the first catch on the first side of the second screen, and engaging the engagement portion of the first latch on the second side of the screen adapter with an engagement portion of the first catch on the first side of the second screen.

The first screen and the screen adapter may be coupled by horizontally sliding the screen adapter into engagement with the first screen or vertically placing (e.g., moving vertically) the screen adapter into engagement with the first screen. The second screen and the screen adapter may be coupled by horizontally sliding the second screen into engagement with the screen adapter or vertically placing the second screen into engagement with the screen adapter.

The first screen, screen adapter, and the second screen may be removed from the vibratory separator by pulling on the first screen or the second screen. The interconnection or coupling of the first screen with the screen adapter and the screen adapter with the second screen may, therefore, also facilitate removal of multiple screens from the vibratory separator.

While the present disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed is:

1. A system comprising:

a first screen having a first latch, a second latch and a first catch provided on a first end of the first screen;

a second screen having a first catch, a second catch and a first latch provided on a first end of the second screen; and a screen adapter for connecting the first screen and the second screen, the screen adapter comprising:

an elongate body having a top surface, a bottom surface, a first side and a second side;

a first catch and a second catch formed on the first side of the elongate body that engage the first latch and the second latch, respectively, on the first end of the first screen;

a first latch and a second latch formed on the second side of the elongate body that engages the first catch and the second catch, respectively, on the first end of the second screen configured to engage another screen;

a third latch formed on the first side of the elongate body that engages the first catch on the first end of the first screen; and a third catch formed on the second side of the elongate body that engages the first latch on the first end of the second screen, wherein each latch comprises an extension portion and an engagement portion of the latch, and each catch comprises a recess, a guide portion and an engagement portion of the catch, and further wherein each corresponding latch and catch are configured to couple the first screen, the second screen and the screen adapter, respectively, by latching and locking the engagement portion of each latch with the engagement portion of each catch, respectively.

2. The system according to claim 1, wherein:

the first latch and second latch on the first end of the first screen are arranged in a first profile on the first end of the first screen; and the first catch and second catch on the first end of the second screen are arranged in a second profile on the first end of the first screen.

3. The system according to claim 1, wherein:

a top surface of the first screen is offset from a bottom surface of the first screen;

a top surface of the second screen is offset from a bottom surface of the second screen;

and a top surface of the screen adapter is offset from a bottom surface of the screen adapter, wherein the top surface of the first screen and the top surface of the screen adapter seal against each other, and wherein the top surface of the second screen and the top surface of the screen adapter seal against each other.

4. The system according to claim 1, wherein the first catch and the first latch are disposed substantially adjacent to the bottom surface of the elongate body.

5. The system according to claim 1, wherein:

the first catch is arranged in a first profile on the first side of the elongate body, and the first latch is arranged in a second profile on the second side of the elongate body.

6. A method comprising:

providing the system, according to claim 1, comprising the first screen, the second screen and the screen adapter inserting the first screen into a vibratory separator;

inserting the screen adapter into the vibratory separator;

coupling the screen adapter to the first screen;

inserting the second screen into the vibratory separator; and coupling the second screen to the screen adapter.

7. The method according to claim 6, wherein the first screen and the second screen are different types of screens.

8. The method according to claim 6, wherein:

coupling the screen adapter to the first screen comprises:

aligning the first latch on the first side of the first screen with the first catch on the first side of the screen adapter; and engaging the first latch on the first side of the first screen with the first catch on the first side of the screen adapter; and coupling the screen adapter to the second screen comprises:

aligning the first latch on the second side of the screen adapter with the first catch on the first side of the second screen; and engaging the first latch on the second side of the screen adapter with the first catch on the first side of the second screen.

9. The method according to claim 6, wherein:

the first screen and the screen adapter are coupled by one of a group consisting of horizontally sliding the screen adapter into engagement with the first screen and vertically placing the screen adapter into engagement with the first screen; and the screen adapter and the second screen are coupled by one of a group consisting of horizontally sliding the second screen into engagement with the screen adapter and vertically placing the second screen into engagement with the screen adapter.

10. The method according to claim 6, further comprising:

removing the first screen, the screen adapter, and the second screen together from the vibratory separator by pulling on one of the first screen or the second screen.

* * * * *